US005799236A

United States Patent [19]

Paczkowski

[11] Patent Number: 5,799,236

[45] Date of Patent: Aug. 25, 1998

[54] FACILITATING DUPLEX COPYING WITH A REPRODUCTION APPARATUS UTILIZING AN INTERMEDIATE TRANSFER MEMBER

[75] Inventor: Francis M. Paczkowski, Spencerport, N.Y.

[73] Assignee: Eastman Kodak Company, Rochester, N.Y.

[21] Appl. No.: 903,583

[22] Filed: Jul. 31, 1997

[51] Int. Cl.[6] ..... G03G 15/00; G03G 15/20

[52] U.S. Cl. ..... 399/309; 399/401

[58] Field of Search ..... 399/302, 308, 399/309, 320, 401

[56] References Cited

U.S. PATENT DOCUMENTS

| | | | |
|---|---|---|---|
| 4,449,475 | 5/1984 | Schinke . | |
| 4,541,705 | 9/1985 | Knechtel | 399/320 |
| 4,588,279 | 5/1986 | Fukuchi et al. . | |
| 4,796,048 | 1/1989 | Bean . | |
| 4,928,147 | 5/1990 | Baumann et al. | 399/337 |
| 5,079,597 | 1/1992 | Mauer et al. . | |
| 5,099,256 | 3/1992 | Anderson . | |
| 5,166,738 | 11/1992 | Tani . | |
| 5,173,735 | 12/1992 | Kusumoto . | |
| 5,187,526 | 2/1993 | Zaretsky . | |
| 5,237,374 | 8/1993 | Ueno et al. . | |
| 5,285,244 | 2/1994 | Bujese . | |
| 5,343,277 | 8/1994 | Rooijakkers et al. . | |
| 5,485,256 | 1/1996 | Randall et al. . | |

*Primary Examiner*—Joan H. Pendegrass
*Attorney, Agent, or Firm*—Lawrence P. Kessler

[57] ABSTRACT

An electrostatographic reproduction apparatus, utilizing an intermediate image transfer member to transfer marking particle images to a receiver member, including a mechanism for facilitating duplex copying. The mechanism for facilitating duplex copying has a prefuser in juxtaposition with a portion of a receiver member travel path, downstream of the intermediate transfer member. An inverter is provided for transporting a receiver member from the prefuser back to the intermediate transfer member in a side-for-side inverted orientation. A control selectively activates the prefuser for tacking a first side image to a receiver member, and diverts such receiver member into the inverter to be transported to the intermediate transfer member to have a second side image formed thereon.

14 Claims, 2 Drawing Sheets

FACILITATING DUPLEX COPYING WITH A REPRODUCTION APPARATUS UTILIZING AN INTERMEDIATE TRANSFER MEMBER

BACKGROUND OF THE INVENTION

The present invention relates in general to reproduction apparatus utilizing an intermediate transfer member, and more particularly to facilitating making duplex copies with a reproduction apparatus utilizing an intermediate transfer member.

In modern high speed/high quality electrostatographic reproduction apparatus (for example, copier/duplicators or printers), a latent image charge pattern is formed on a uniformly charged dielectric support member. Pigmented marking particles are attracted to the latent image charge pattern to develop such image on the support member. The dielectric support member is then brought into contact with a receiver member and an electric field applied to transfer the marking particle developed image to the receiver member from the dielectric support member. After transfer, the receiver member bearing the transferred image is transported away from the dielectric support member, and the image is fixed to the receiver member by heat and/or pressure to form a permanent reproduction thereon.

A recent advance in reproduction systems shows the use of intermediate transfer members for both single color image formation and multicolor image formation. In multicolor image formation, individual single color separation images are sequentially transferred, in registration, to an intermediate transfer member to create a multicolor image on the surface of such transfer member. The resultant multicolor image is then transferred in a single step to a receiver member. This system is particularly advantageous in forming multicolor marking particle images because the receiver member does not have to be attached to a transfer member for recirculation to sequentially receive the individual color separation images, but can be fed along a substantially straight path and receive all images in the one transfer step. The system can also be used in conjunction with single color marking particle image formation, for example for facilitating in the making of duplex copies.

In U.S. Pat. No. 5,187,526, in the name of Zaretsky, issued Feb. 16, 1993, there is shown a transfer arrangement which includes the advantages that are obtained from use of an intermediate transfer member, while still being able to handle a variety of receiver members of differing characteristics and operating at desirable speed. In this arrangement, an electrostatic image is formed on a primary image member. Marking particles are applied to an electrostatic latent image on the primary image member to create a developed marking particle image corresponding to the latent image. The marking particles image is carried by a primary image member into transfer relation with an intermediate transfer member having a resistivity less than $10^9$ ohm-cm. An electric field is applied between the primary image member and the intermediate transfer member sufficient to transfer the marking particle image to the intermediate transfer member.

Thereafter, the marking particle image on the intermediate transfer member is brought into transfer relation with a receiver member while the receiver member is backed by a transfer backing member. The transfer backing member has a resistivity of $10^{10}$ ohm-cm or greater in the presence of an electric field between the intermediate transfer member and the transfer backing member urging transfer of the marking particle image to the receiver member. The relatively high conductivity of the intermediate transfer member facilitates efficient transfer of marking particle images from the primary image member to the intermediate transfer member using a fairly narrow transfer nip. A high resistance intermediate transfer member is not necessary during this transfer because no receiver member is present. At the second transfer in which the receiver member is present, impedance is provided by the transfer backing member rather than the intermediate transfer member and the nip is somewhat longer allowing for the slower rise time of the electric field.

With modern high speed reproduction apparatus, it is often desired to make duplex copies (i.e., copies bearing information reproduction on both sides thereof). Duplex copies provide for the conservation of receiver members, and the material from which they are formed, as well as saving on space required for the filing of an equivalent number of simplex (single sided) copies. However, the making of duplex copies has been somewhat difficult with the above described reproduction apparatus that utilize an intermediate transfer member. This is due, at least in part, to the fact that in the typical process for making duplex copies, the first side copy is fused on the receiver member and may collect some of the fuser oil used to prevent marking particle images from offsetting onto the fuser assembly. This collected fuser oil can then transfer to the intermediate transfer member when the receiver member is returned to the intermediate transfer member (i.e., during second side copying). The fuser oil contaminates the intermediate transfer member and interferes with the ability of the intermediate transfer member to efficiently transfer marking particles to the receiver member. Such contamination may cause unacceptable image artifacts in second side reproduction, or in subsequent copies.

SUMMARY OF THE INVENTION

In view of the foregoing discussion, this invention is directed to an electrostatographic reproduction apparatus, utilizing an intermediate image transfer member to transfer marking particle images to a receiver member, including a mechanism for facilitating duplex copying. The mechanism for facilitating duplex copying has a prefuser in juxtaposition with a portion of a receiver member travel path, downstream of the intermediate transfer member. An inverter is provided for transporting a receiver member from the prefuser back to the intermediate transfer member in a side-for-side inverted orientation. A control selectively activates the prefuser for tacking a first side image to a receiver member, and diverts such receiver member into the inverter to be transported to the intermediate transfer member to have a second side image formed thereon.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
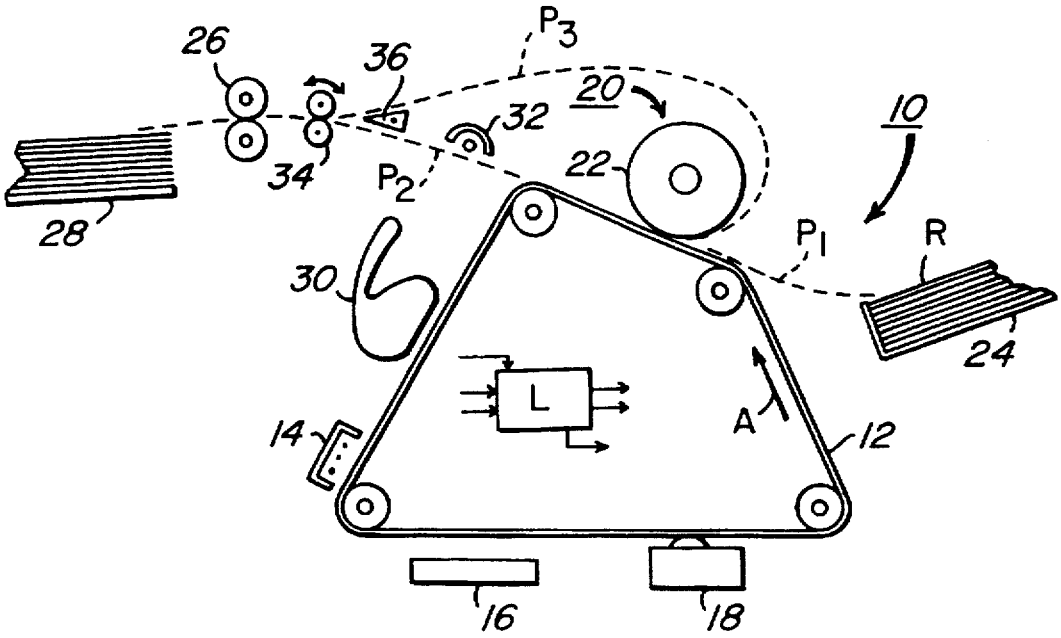
FIG. 1 is a schematic side elevational view of an electrostatographic reproduction apparatus utilizing an intermediate transfer member, and including the mechanism for facilitating duplex copying according to this invention.

Referring now to the accompanying drawings, FIG. 1 shows a schematic side elevational view of an electrostatographic reproduction apparatus, designated generally by the numeral 10, including the mechanism for facilitating duplex copying according to this invention. The reproduction apparatus 10 includes a dielectric support member 12, for example, in the form of an endless web mounted on support rollers and movable about a closed loop path in the direction of arrow A through a series of electrographic process stations. Of course, this invention is suitable for use with other dielectric support member configurations, such as drums for example. In the reproduction cycle for the reproduction apparatus 10, the moving dielectric support member 12 is uniformly charged as it moves past a charging station 14.

Thereafter the uniformly charged dielectric support member passes through an exposure station 16 where the uniform charge is altered to form a latent image charge pattern corresponding to information desired to be reproduced. Depending upon the characteristics of the dielectric support member and the overall reproduction system, formation of the latent image charge pattern may be accomplished by exposing the dielectric support member to a reflected light image of an original document to be reproduced or "writing" on the dielectric support member with a series of lamps (e.g., LED's or lasers) or point electrodes activated by electronically generated signals based on the desired information to be reproduced. The latent image charge pattern on the dielectric support member 12 is then brought into association with a development station 18 which applies pigmented marking particles to adhere to the dielectric support member to develop the latent image. The portion of the dielectric support member carrying the developed image then passes through a transfer station 20.

Figure 2:
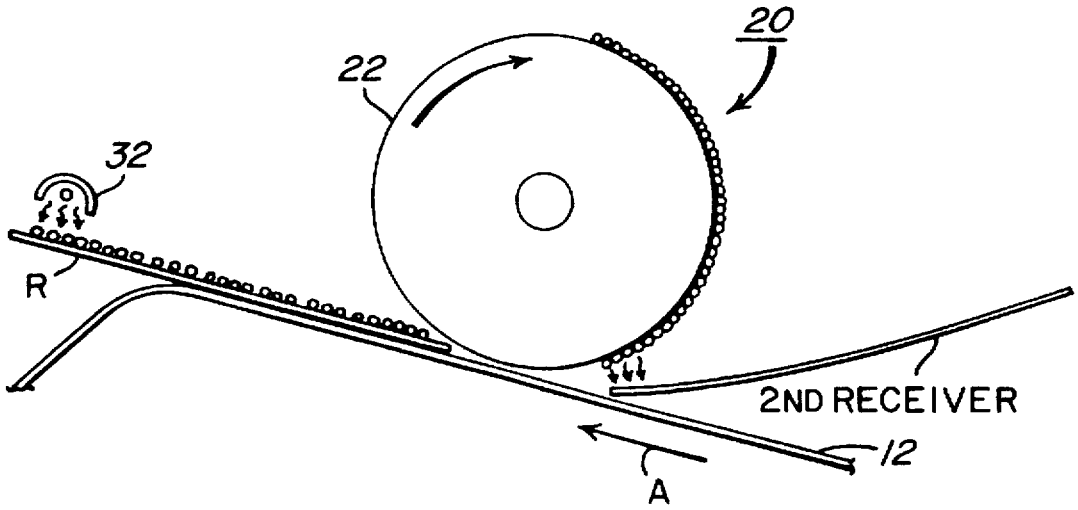
FIG. 2 is a schematic side elevational view of a portion of the reproduction apparatus of FIG. 1 showing that step in the reproduction process when the first side of a duplex reproduction is being formed.

The transfer station 20 includes an intermediate transfer roller 22 of a similar construction to that such as described in detail in the aforementioned U.S. Pat. No. 5,187,526. The intermediate transfer roller 22 is referred to as an intermediate transfer roller due to the fact that a marking particle developed image is first transferred from the dielectric support member 12 to the intermediate transfer roller, and subsequently transferred from the intermediate transfer roller in register to a receiver member R fed in proper timed relation from a supply hopper 24, along the travel path $P_1$. An electric field produced by the intermediate transfer roller 22 first attracts the marking particles of the developed image from the dielectric support member 12 to the peripheral surface of the intermediate transfer roller, and thereafter repels the marking particle image from the surface of the intermediate transfer roller to the receiver member (see FIG. 2).

After the developed image is transferred to the receiver member and the receiver member is separated from the dielectric support member 12, the receiver member is transported along the path $P_2$ through a fusing device 26 where the image is fixed to the receiver member by heat and/or pressure for example. The receiver member bearing the fused marking particle image is thereafter delivered to an output hopper 28 for operator retrieval. Simultaneously, the dielectric support member 12 is cleaned of any residual marking particles at cleaning station 30 and returned to the charging station 14 for reuse.

It should be noted that during the reproduction process the electrostatographic reproduction apparatus 10 is under the control of a microprocessor-based logic and control unit L of any well known type. Based on appropriate input signals and programs supplied by software control algorithms associated with the microprocessor, the logic and control unit L provides signals for controlling the operation of the various functions of the reproduction apparatus for carrying out the reproduction process. The production of suitable programs for commercially available microprocessors is a conventional skill well understood in the art. The particular details of any such programs would, of course, depend upon the architecture of the designated microprocessor.

When the reproduction apparatus 10 is in the duplex copying mode, the receiver member R is returned to the intermediate transfer roller 22 to receive a marking particle image, from the intermediate transfer roller, on the opposite side of the receiver member from the first image side. In order to avoid the problems discussed above regarding fuser oil contamination a prefuser 32, according to this invention, is provided. The prefuser 32 is located downstream of the intermediate transfer roller 22, in juxtaposition with the travel path $P_2$, and before the area where the receiver member is returned to the intermediate transfer roller. In the drawings, the prefuser 32 is shown as a radiant energy heater such as a lamp. Of course, the prefuser could be of any suitable radiant energy source, such as for example a heated plate or transport assembly.

Figure 3:
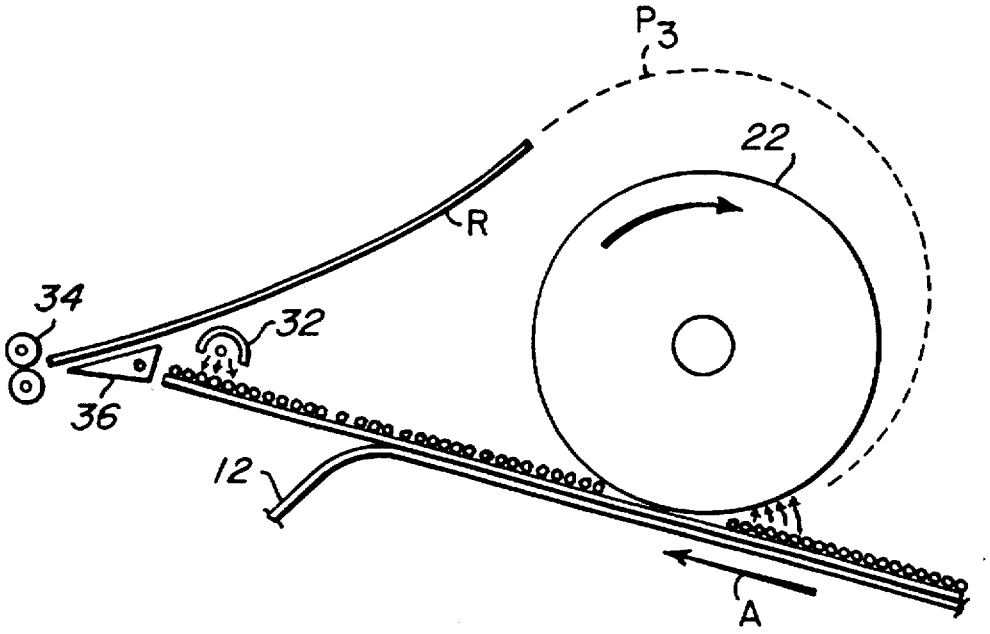
FIG. 3 is a schematic side elevational view of the portion of the reproduction apparatus of FIG. 1 showing that step in the reproduction process when the first side of a duplex reproduction is being fused.

The prefuser 32 is selectively activated by the logic and control unit L to heat the marking particle image on the first side of the receiver member R as it is transported along the travel path $P_2$. Heating is sufficient to at least partially melt the marking particles so that the particles become tackified so as to adhere to the receiver member on the first side thereof. Thereafter, the receiver member R is transported back to the intermediate transfer roller 22 along a travel path $P_3$ (see FIG. 3). The travel path $P_3$ extends from downstream of the prefuser 32 to upstream of the intermediate transfer roller 22.

Figure 4:
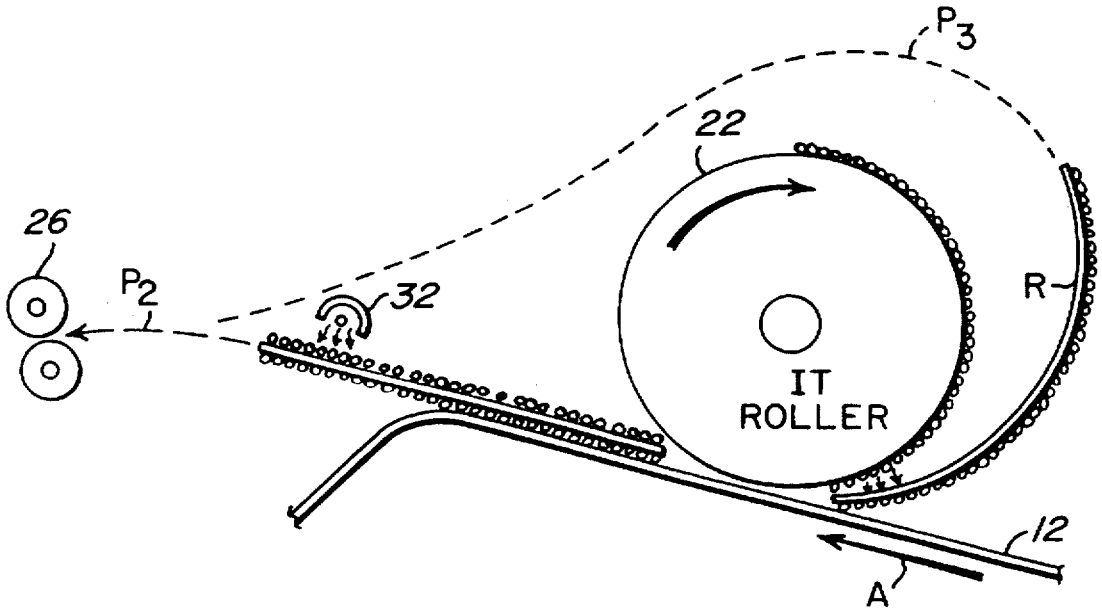
FIG. 4 is a schematic side elevational view of a portion of the reproduction apparatus of FIG. 1 showing that step in the reproduction process when the second side of a duplex reproduction is being formed.

Nip rollers 34 are operatively associated with the travel path $P_2$. The nip rollers, under the control of the logic and control unit L, are first driven in a direction which causes the receiver member R to be transported completely through the prefuser 32. Once the receiver member has been prefused, the drive to the nip rollers 34 is reversed, and a diverter 36 is selectively inserted into the travel path $P_2$. The diverter 36, also under the control of the logic and control unit L, directs the receiver member transported by the nip rollers 34 into the travel path $P_3$, with the trail edge of the receiver member becoming the lead edge. Further, due to the configuration of the travel path $P_3$, when the receiver member is returned to transfer association with the intermediate transfer roller 32, such receiver member is in a side-for-side inverted orientation so as to enable a second side image, transferred to the intermediate transfer roller 22 from the dielectric support member 12, to be transferred thereto (see FIG. 4). Once the second side image has been transferred to the receiver member, the receiver member is transported along the travel path $P_2$ to the fuser assembly 26 where the permanent fusing of the images to both sides of the receiver member is completed prior to delivery to the output hopper 28.

There are several additional benefits that are gained by utilizing the prefuser 32 according to this invention to facilitate duplex copying in a reproduction apparatus utilizing an intermediate transfer member. Heating of the receiver member prior to final permanent fusing aids in the drying of the receiver member. This will substantially reduce any problems associated with the moisture content of a receiver member, such as cockling, blistering or wrinkling of the receiver member. It may also reduce fuser temperature droop, and enhance the handling of heavier weight receiver members which require more thermal energy.

The invention has been described in detail with particular reference to preferred embodiment thereof, but it will be understood that variations and modifications can be effected within the spirit and scope of the invention as set forth in the claims.

| PARTS LIST |
|---|
| 10- electrostatographic reproduction apparatus |
| 12- dielectric support member |
| 14- charger |
| 16- exposure station |
| 18- development station |
| 20- transfer station |
| 22- intermediate transfer roller |
| 24- receiver member supply |
| 26- fuser assembly |
| 28- output hopper |
| 30- cleaning station |
| 32- prefuser |
| 34- nip rollers |
| 36- diverter |
| A- direction arrow |
| L- logic and control unit |
| $P_1$- receiver travel path |
| $P_2$- receiver travel path |
| $P_3$- receiver travel path |
| R- receiver member |

What is claimed is:

1. An electrostatographic reproduction apparatus, utilizing an intermediate image transfer member to transfer marking particle images to a receiver member transported along a travel path, said reproduction apparatus including a mechanism for facilitating duplex copying, said mechanism for facilitating duplex copying comprising:

a prefuser located in juxtaposition with a portion of a receiver member travel path, downstream of said intermediate transfer member;

an inverter for transporting a receiver member from said prefuser back to said intermediate transfer member in a side-for-side inverted orientation; and a control for selectively activating said prefuser for tacking a first side image to a receiver member, and diverting such receiver member into said inverter to be transported back to said intermediate transfer member to have a second side image formed thereon.

2. The mechanism for facilitating duplex copying according to claim 1 wherein said prefuser is of the non-contact type.

3. The mechanism for facilitating duplex copying according to claim 2 wherein said non-contact type prefuser is a radiant energy heater.

4. The mechanism for facilitating duplex copying according to claim 1 wherein said inverter includes a path from downstream of said prefuser to upstream of said intermediate transfer member.

5. The mechanism for facilitating duplex copying according to claim 4 wherein said inverter includes a drive for selectively inserting a receiver member in said inverter path with the trail edge of said receiver member becoming the lead edge.

6. The mechanism for facilitating duplex copying according to claim 5 wherein said drive includes reversibly driven nip rollers and a diverter selectively insertable into said travel path, whereby said nip rollers are driven in a first direction to transport a receiver member through said prefuser, and driven in the reverse direction when said diverter is inserted in said travel path by said control to insert a receiver member in said inverter path.

7. A method for facilitating duplex copying for an electrostatographic reproduction apparatus utilizing an intermediate image transfer member to transfer marking particle images to a receiver member, said method for facilitating duplex copying comprising the steps of:

transferring a marking particle image to a first side of a receiver member;

prefusing such transferred marking particle image to said receiver member;

inverting said receiver member after prefusing and transporting the inverted receiver member back to said intermediate transfer member in a side-for-side inverted orientation; and transferring a second side image thereon.

8. The method for facilitating duplex copying according to claim 7 wherein prefusing is accomplished by application of radiant energy heat.

9. The method for facilitating duplex copying according to claim 7 wherein, upon inversion of the receiver member the trail edge of said receiver member becomes the lead edge.

10. The method for facilitating duplex copying according to claim 7 including the further step of, after transferring the second side image, permanently fusing both the first side image and the second side image to such receiver member.

11. An electrostatographic reproduction apparatus, utilizing an intermediate image transfer member to transfer marking particle images to a receiver member, including a mechanism for facilitating duplex copying, said mechanism for facilitating duplex copying comprising:

a receiver member travel path extending from a supply of receiver members into operative association with the intermediate transfer member of said reproduction apparatus, and the to an output hopper;

a non-contact prefuser in juxtaposition with a portion of a receiver member travel path, downstream of said intermediate transfer member;

an inverter for transporting a receiver member from said prefuser back to said intermediate transfer member, upstream of the operative association location, in a side-for-side inverted orientation;

a permanent fuser assembly, located downstream of said prefuser and said inverter, for fusing both the first side image and the second side image to such receiver member; and a control for selectively activating said prefuser for tacking a first side image to a receiver member, and diverting such receiver member into said inverter to be transported to said intermediate transfer member to have a second side image formed thereon.

12. The mechanism for facilitating duplex copying according to claim 11 wherein said non-contact type prefuser is a radiant energy heater.

13. The mechanism for facilitating duplex copying according to claim 11 wherein said inverter includes a drive for selectively inserting a receiver member in said inverter path with the trail edge of said receiver member becoming the lead edge.

14. The mechanism for facilitating duplex copying according to claim 13 wherein said drive includes reversibly driven nip rollers and a diverter selectively insertable into said travel path, whereby said nip rollers are driven in a first direction to transport a receiver member through said prefuser, and driven in the reverse direction when said diverter is inserted in said travel path by said control to insert a receiver member in said inverter path.

* * * * *